US006647672B1

(12) United States Patent
Knight

(10) Patent No.: US 6,647,672 B1
(45) Date of Patent: Nov. 18, 2003

(54) DOMED BUILDING STRUCTURE

(76) Inventor: Brian Valentine Knight, 8 Pleasantview Ave., New Hartford, NY (US) 13413

( * ) Notice: Subject to any disclaimer, the term of this patent is extended or adjusted under 35 U.S.C. 154(b) by 0 days.

(21) Appl. No.: 09/743,437

(22) PCT Filed: Jul. 13, 1999

(86) PCT No.: PCT/GB99/02239

§ 371 (c)(1),
(2), (4) Date: Jan. 9, 2001

(87) PCT Pub. No.: WO00/04246

PCT Pub. Date: Jan. 27, 2000

(30) Foreign Application Priority Data

Jul. 14, 1998 (GB) ..... 9815301

(51) Int. Cl.[7] ..... E04B 1/32
(52) U.S. Cl. ..... 52/81.4; 52/81.5
(58) Field of Search ..... 52/80.1, 80.2, 52/81.1, 81.2, 81.3, 81.4, 81.5, 81.6, 82, DIG. 10

(56) References Cited

U.S. PATENT DOCUMENTS 3,820,292 A * 6/1974 Fitzpatrick ..... 52/81
4,263,758 A * 4/1981 Seaich ..... 52/81
4,285,174 A 8/1981 Knight
4,665,664 A 5/1987 Knight
4,686,801 A 8/1987 Eriksson et al.
5,170,599 A 12/1992 Knight
5,337,460 A 8/1994 Cockfield et al.
5,377,460 A * 1/1995 Hicks ..... 52/81.1
5,502,928 A 4/1996 Terry
6,134,849 A * 10/2000 Holler ..... 52/80.1

FOREIGN PATENT DOCUMENTS

EP 0773331 A1 5/1997
WO WO 9208024 5/1992

* cited by examiner

*Primary Examiner*—Lanna Mai
*Assistant Examiner*—Dennis L. Dorsey
(74) *Attorney, Agent, or Firm*—Arnold B. Silverman; William F. Lang, IV; Eckert Seamans Cherin & Mellott, LLC

(57) ABSTRACT

Domed building structures are disclosed comprising a series of concentric rings or frustums, each comprising a plurality of panels (4, 5, 6, 8, 30, 32A, 32B, 32C) connected end to end around the ring. Some rings comprise only trapezoidal panels (4) whilst others comprise combinations of trapezoidal (6, 30) and triangular (8, 32A, 32B, 32C) panels. Some rings or frustums may incorporate bracing comprising ties (52, 54) disposed in the interior of the structure and connected with junctions between panels (50).

2 Claims, 6 Drawing Sheets

DOMED BUILDING STRUCTURE

Figure 1:
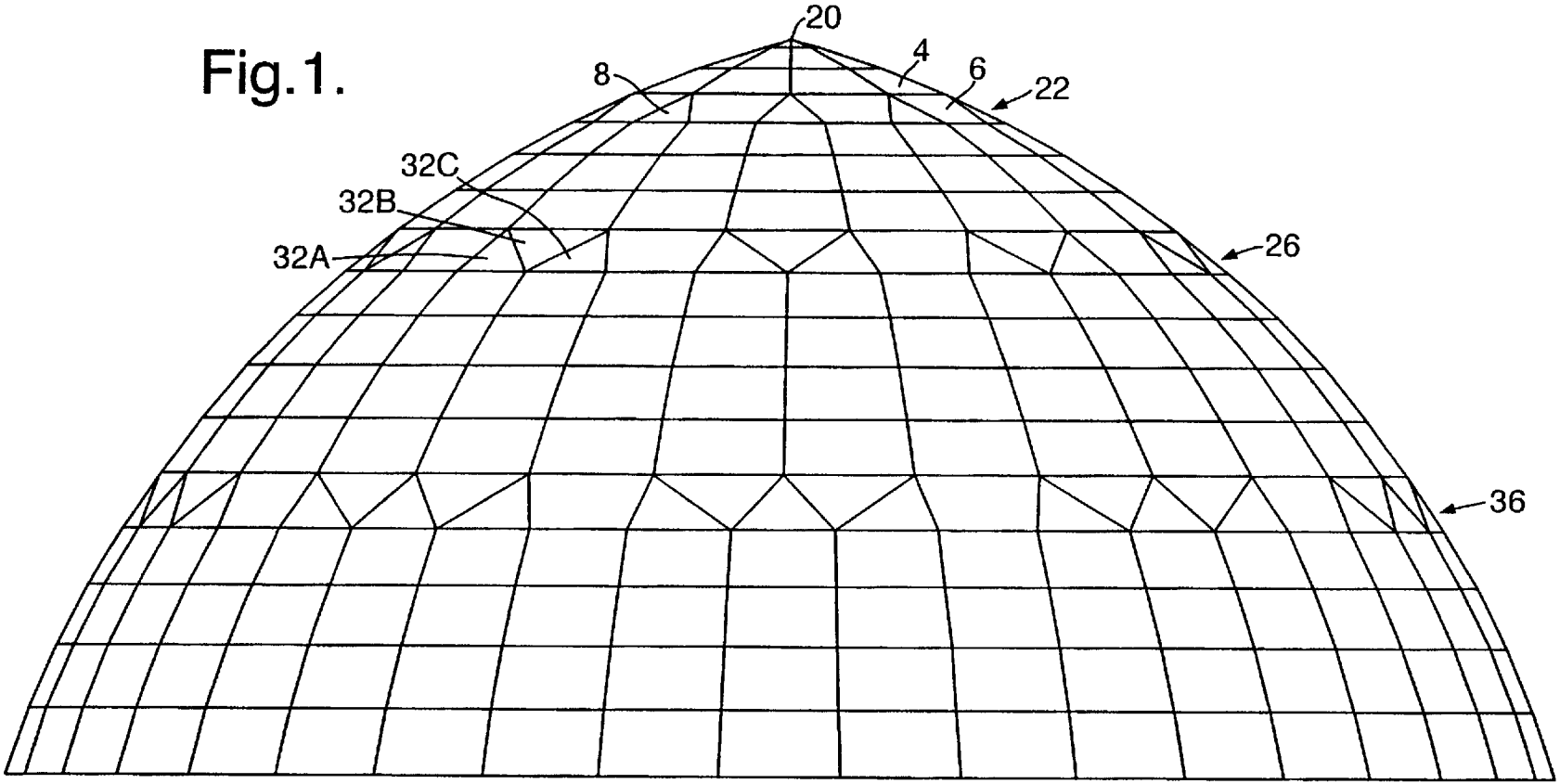

THIS INVENTION relates to a domed building structure assembled from a plurality of individual panels. Domed building structures of this general type are disclosed, for example, in U.S. Pat. Nos. 4,285,174; 4,665,664; 4,686,801 and 5,170,599, and EP-0773331A, to which reference should be had.

More particularly, the invention relates to a domed building structure comprising a plurality of substantially concentric parts disposed one above the other and including a central upper apex part and one or more lower parts each forming a respective frustum adjoining the part immediately above, and wherein each said frustum is formed of a plurality of panels each extending from the upper inner edge of the frustum to the lower outer edge.

The design of such domed structures is subject to various constraints, in addition to the normal physical and engineering constraints. Thus, whilst it is generally highly desirable, from the point of view of ease of manufacture and hence cost, that the individual panels making up such a structure should be substantially planar, with straight edges, this normally implies, in the case of a structure comprising a succession of tiered frustums, of the kind referred to above, that the number of panels in each frustum must be the same, with the consequence that the panels in the lower frustums are excessively large or at least excessively elongate in the circumferential direction of the frustum and/or that the panels of the upper frustums are unnecessarily narrow, both of which circumstances give rise to increased costs, including increased assembly costs and handling and transportation costs. Thus the problem arising in the prefabricating, or panelling of large diameter dome structures of the kind referred to, where these are of timber construction, is the limited availability of standard cross-sectional dimension timber in long lengths. Also as the length of a panel increases so does the load and stress that has to be resisted by that panel, so that larger cross-section timer and/or plywood is required to make the panel. These difficulties place a practical and economical limitation on the size of those structures.

The construction proposed in U.S. Pat. No. 5,377,460 does to a certain extent meet this problem but does not go far enough. It is limited to reducing the number of panels in succeeding rings or frustum is to one half at a diameter that is decided geometrically based on the number of panels in the lower-most ring.

It is one of the objects of the present invention to provide an improved dome structure of the kind referred to.

According to the invention, there is provided a domed building structure comprising a plurality of substantially concentric parts disposed one above the other and including a central upper apex part and one or more lower parts each forming a respective frustum adjoining the part immediately above, and wherein each said frustum is formed of a plurality of straight-edged panels. each extending from the upper inner edge of the frustum to the lower outer edge, each junction between panel edges at each said upper inner edge of the or each frustum being coincident with a respective junction between panel edges at the adjoining edge of the frustum or central upper part immediately above, and at least one said frustum comprising both four-sided and triangular panels, with each triangular panel having an apex coincident with a junction between four-sided panels in the upper inner edge of the respective frustum, and having a base forming a respective part of the lower outer edge of the respective frustum, and wherein each said four sided panel is trapezoidal, with the shorter of its parallel edges lying in the lower, outer, edge of the frustum and the longer of its parallel edges lying in the upper, inner edge of the frustum.

Figure 2:
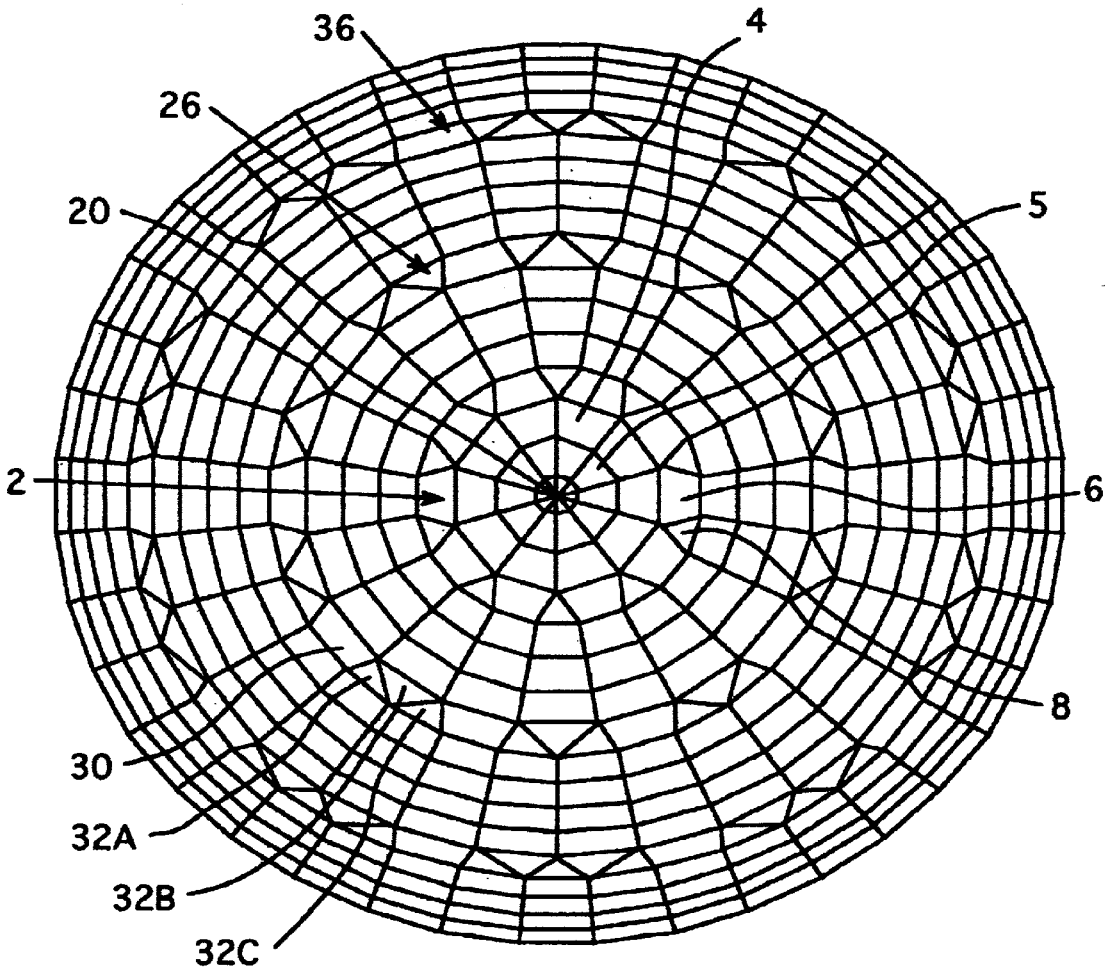
Figure 3:
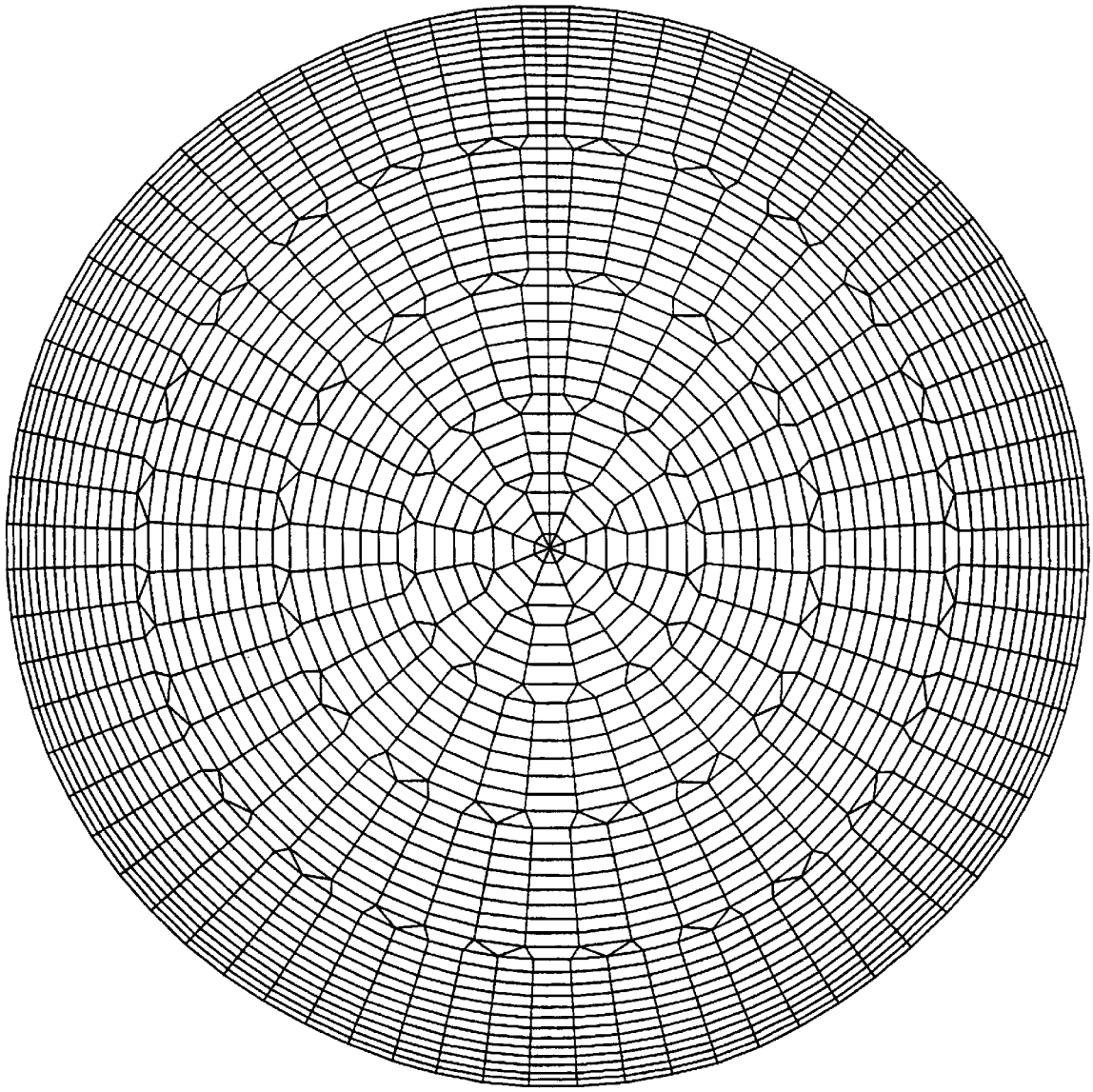
Figure 4:
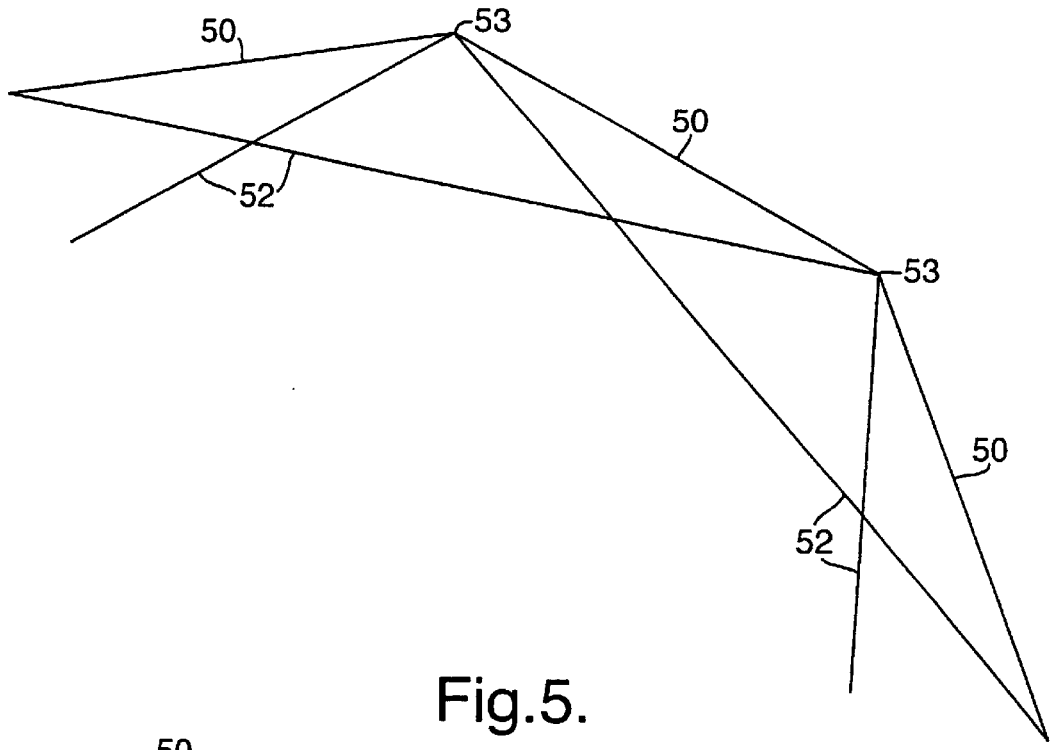
Figure 5:
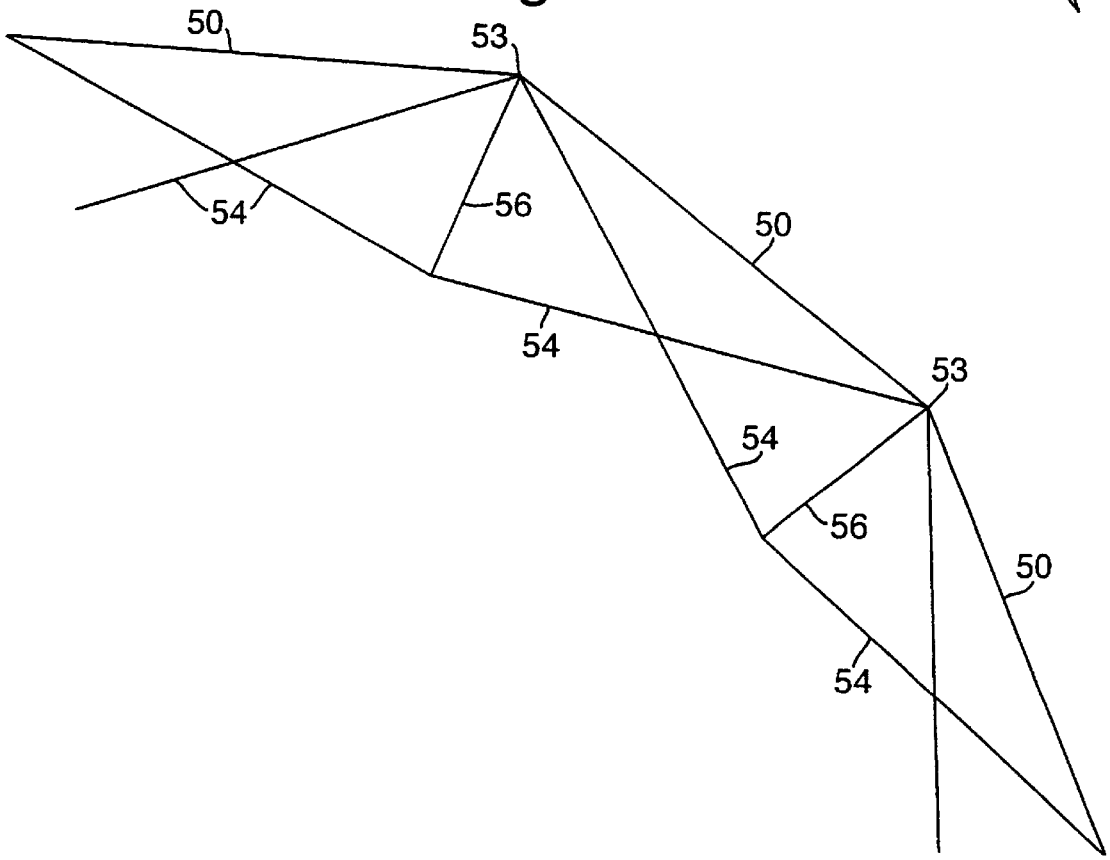
Figure 6:
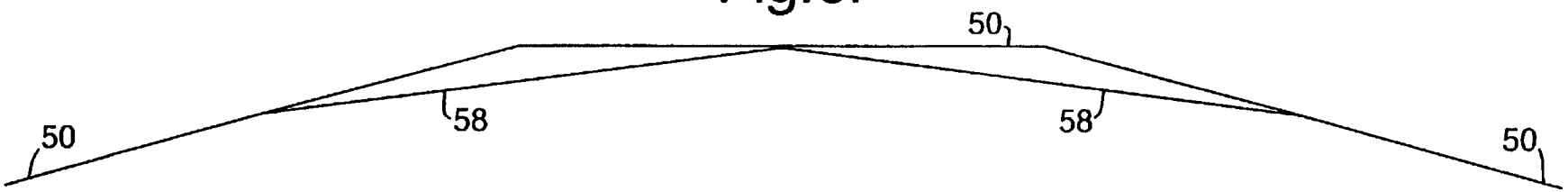
Figure 7:
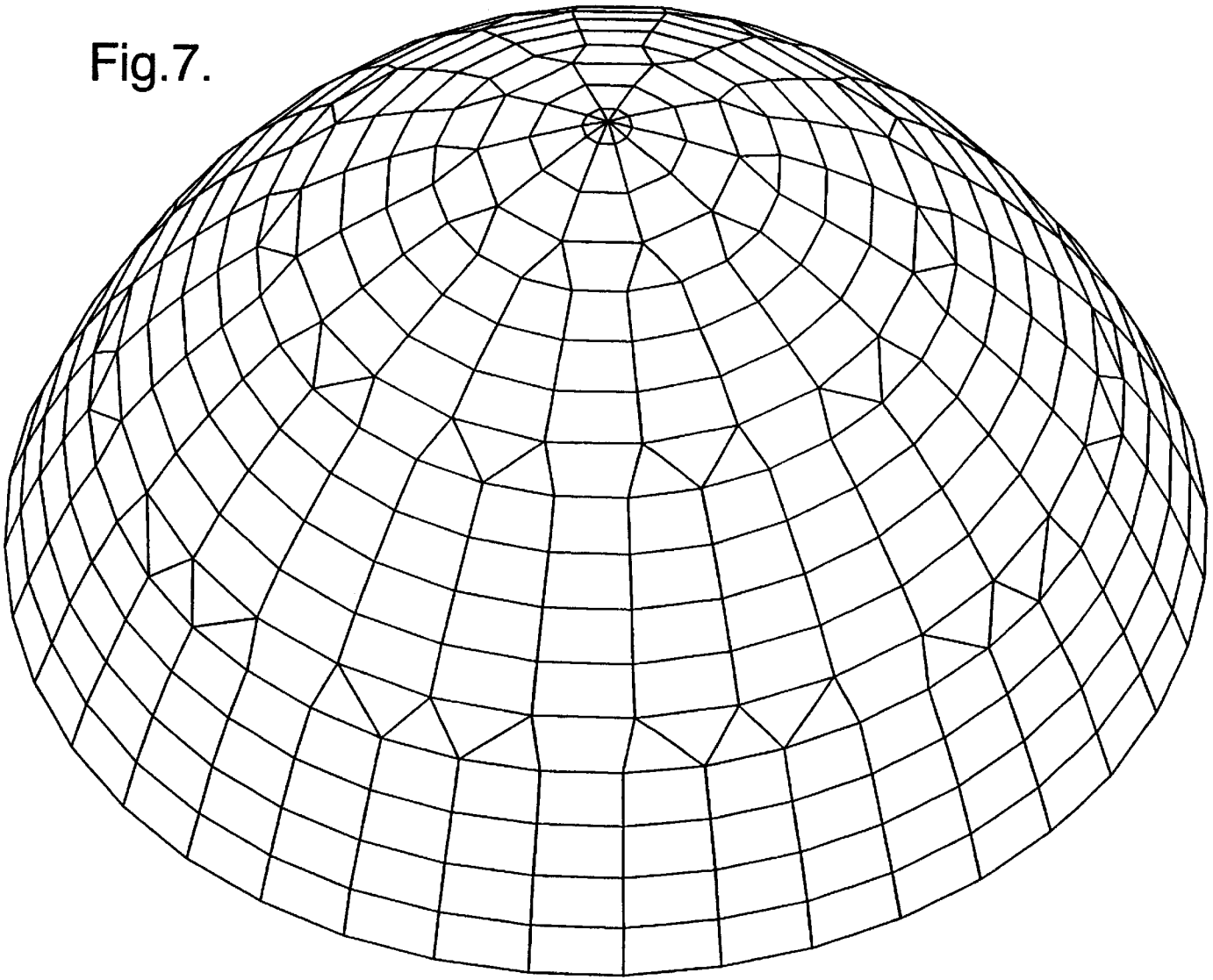

Embodiments of the invention are described below by way of example with reference to the accompanying drawings in which:

FIGS. 1 and 2 are respectively a side elevation and a plan view of a dome structure in accordance with the present invention, FIG. 3 is a plan view of a larger dome structure embodying the present invention, FIGS. 4, 5 and 6 are schematic fragmentary plan views illustrating internal bracing arrangements of domes embodying the invention, and FIG. 7 is a perspective view of the dome structure of FIGS. 1 and 2.

Referring to FIGS. 1 and 2, the domed structure shown comprises a roof or skin formed by a plurality of individual, flat, straight-edged panels fitted together edge to edge. The panels may, for example, be individually glazed frames, with the frames forming the entire supporting structure of the dome, or the panels may be supported on an underlying supporting framework or bracing.

The domed structure illustrated comprises a central, uppermost part 20 and, disposed outwardly from and below the part 20, a plurality of concentric rings or frustums, each comprising a ring of panels connected edge to edge, each panel extending from the upper inner edge of the respective frustum to the lower outer edge thereof. In the arrangement shown in FIG. 1, the central portion 20 comprises a plurality (10 in the example shown) of triangular panels arranged with their apices on the common vertical centre line of the structure and with their bases forming the periphery of the pall 20, these triangular panels lying edge to edge so that the adjoining edges lie on respective "lines of longitude" of the dome structure. Disposed immediately outwardly of and below the part 20 is a frustum of interconnected trapezoidal panels 5, with the upper edge of each panel 5 being coincident with the base of a respective triangular panel and with the lower edge, parallel with the upper edge, forming part of the lower edge of that frustum, the panels 5 meeting one another along respective "lines of longitude" of the structure. Likewise, disposed outwardly of and below the frustum of panels 5 is a further frustum made up of trapezoidal panels 4 each having a shorter edge, forming part of the inner and upper edge of the frustum, adjoining and coincident with the lower edge of a respective panel 5, each panel 4 having a parallel lower edge forming a respective part of the lower and outer edge of the respective frustum of panels 4. It will be appreciated that, in this structure, the width, measured horizontally, (i.e. along a "line of latitude") of each panel 4 is greater than that of each panel 5. It will be appreciated that if the same procedure were followed in developing the structure downwardly, with successive frustums being composed of the same numbers of successively wider trapezoidal panels, the panels closest to the ground would be of substantial length, measured circumferentially of the structure. EP-0773331 discloses a technique for avoiding this difficulty, by interposing triangular panels between adjoining trapezoidal panels in certain of the frustums to increase the number of lower discrete edges in such frustums and accordingly increase the number of panels in the lower, outer frustums as compared with the inner, upper frustums. However it has been found that, beyond a certain structure size or total number of panels, the structure of EP-0773331, in certain weather conditions and loadings, can be prone to excessive twisting about its vertical central axis.

It is one object of the invention to provide a structure which is more resistant to such twisting.

In the structure of FIGS. 1 and 2, the frustum of panels 4 is followed by a frustum 22 comprising trapezoidal panels 6 and triangular panels 8 arranged alternately around the frustum, each panel, again, extending from the upper inner edge of the frustum to the lower outer edge thereof. The upper edge of each trapezoidal panel 6 adjoins and is coterminous with the lower edge of a respective one of the trapezoidal panels 4 in the next upper frustum. Each panel 8, on the other hand, interposed between two adjoining panels 6, has its apex coincident with the junction between two adjoining panels 4 in the frustum above and between the upper edges of the two panels 6 on either side of the triangular panel. The lower edge or base edge of each triangular panel 8 forms, with the lower edges of the panels 6, the lower outer periphery of this particular frustum 22. Thus, whereas each frustum above frustum 22 comprises ten panels, the frustum 22 comprising panels 6 and 8 has twenty panels, namely ten panels 6 and ten panels 8. The arrangement of panels 6 and 8 in their frustum 22 is similar to that in certain frustums in the dome structure of EP-0773331 except that the quadrilateral panels 6 are trapezoidal rather than rectangular and the triangular panels 8 have bases which are wider in relation to their sides than the corresponding triangular panels in the structure of EP0773331. However the resulting, more pronounced, angling of the panel edges which extend between the upper and lower edges of the frustum 22 already makes for all increase in torsional rigidity of the frustum about the vertical axis of the structure.

Directly below and outward of the frustum 22 of panels 6, 8, is a frustum formed by twenty similar trapezoidal panels and a series of two similar such frustums is provided below that frustum, each frustum comprising twenty trapezoidal panels, each such trapezoidal panel having its upper edge co-terminous with the lower edge of a respective trapezoidal panel in the frustum above. Below, and outwardly of, the last noted series of frustums is a frustum 26 comprising ten trapezoidal panels 30 and thirty triangular panels 32A, 32B and 32C, each trapezoidal panel 30 having its longer upper edge co-terminous with the lower edge of a respective trapezoidal panel in the frustums above and the triangular panels 32A, 32B and 32C being arranged in groups of three adjacent panels, with each group of three being interposed between two trapezoidal panels 30. As shown, each group of three triangular panels 32A, 32B and 32C in frustum 26 comprises a central isosceles triangle 32B having its apex directed downwardly, the central triangular panel being disposed between two triangular panels 32A and 32C having their apices directly upwardly. Thus, each group of three triangular panels provides one panel edge in the upper edge of the frustum 26 and two panel edges in the lower edge of the frustum 26. Disposed below and outwardly of this frustum 26 is a series of four frustums each comprising thirty similar trapezoidal panels respectively, followed by a frustum 36 comprising ten trapezoidal panels, and ten groups of triangular panels, each group of triangular panels being interposed between two trapezoidal panels, and each group of triangular panels comprising five triangular panels, the triangular panels in each such group of five being arranged alternately with their bases and apices uppermost, with each triangular panel extending from the upper inner periphery of the frustum 36 to the lower outer periphery, each group of five triangular panels comprising three panels having their bases in the lower, outer periphery of the frustum and two further triangular panels each disposed between two of the other panels with its "apex" lowermost and its base uppermost. Accordingly, each group of five triangular panels provides two panel edges in the upper edge of frustum 36 and three panel edges in the lower edge of frustum 36. The frustum 38 thus provides, along its lower outer periphery, forty panel edges, met by respective edges of forth similar trapezoidal panels forming the next lower, outer frustum, and so on.

Structures embodying the invention may all, however, be implemented using straight-edged panels of relatively simple construction, since a junction between panels in any frustum never occurs at an intermediate position along an edge of a panel in an immediately adjoining frustum.

The design technique described with reference to FIGS. 1 and 2, utilizing isosceles and non-isosceles triangles and trapeziums will accordingly allow tile number of panels in a ring or frustum from one frustum to the next higher one to be reduced by differing amounts, and the diameter (and height) where the transition takes place can be determined by the designer. One example of panel reduction is 40–30–20–10 as shown in FIGS. 1 and 2. Another example of a scheme for steps in reduction of the number of panels per frustum, (again moving from bottom to top), is 72–48–32–16–8, the number of panels in each ring being divisible by four, in this case. Such an arrangement is shown in plan in FIG. 3.

The structure described with reference to FIGS. 1 and 2 may, for example be 55 m in diameter and approximately 26 m high, requiring 490 panels. For a structure of similar size and profile utilizing the design of U.S. Pat. No. 5,377,460, a total of 540 panels would be required. This is a saving of 50 panels that do not have to be manufactured or erected on the site.

As can be seen from the geometry there is a "toothed-interlocking" effect at each transition ring or frustum (22, 26, 36) which greatly enhances the resistance to twisting.

In the transition rings or frustums (22, 26, 36), selected triangular "panels" may, without significantly weakening the structure, be provided simply by corresponding panes of glass or other translucent material for lighting or may be left out altogether (thus taking the foam of triangular openings) for ventilation. Of course, where such a panel was left out altogether, a dormer would need to be constructed to maintain the structure's weather-proofing. The triangular panels thus selected for glazing or ventilation may be selected from the isosceles triangles.

It will be understood that, if desired, for example for rigidity, at least some of the frustums making up the domed structure may comprise exclusively triangular panels and may provide the same number of panel edges at the upper and lower periphery of the respective frustum or may provide more such panel edges at the lower periphery. Likewise depending on the number of panels and the size of the structure, the triangular panels may be grouped in groups of any appropriate number, with trapezoidal panels, or rectangular panels interposed between such groups. Likewise the trapezoidal or rectangular panels may be arranged in groups, or singly.

With very large dome structures of the kind under discussion, in which, below certain levels, there are a large number of individual panels per frustum, there may be a tendency for the structure to undergo flexural movements in which adjoining panels pivot relative to one another about edges or vertices which are common to the panels, even though the part-spherical form of the structure inhibits such flexural distortions. In order to minimise such flexing, selected frustums in the structure may be constructed as, in effect, annular trusses. Thus, as illustrated in FIG. 4, which represents a portion of such an annular truss viewed in plan, the references 50 indicate adjoining panel edges forming one periphery of such a frustum, for example the lower periphery, each junction 53 between panel edges 50 may be connected by a respective tie or brace 52 to each of the next-to-adjoining junction 53, so that alternate junctions 53 are connected by common ties or braces 52. In this way, the structure is stiffened considerably against local radial inward or outward deflections, for example.

In a variant arrangement, illustrated in FIG. 5, a respective strut 56 may extend radially inwardly with respect to the dome structure from each junction 53, with the radially inner end of each strut 56 being connected by ties 54 with the adjoining junction 53 oil either side.

In a further variant, illustrated in FIG. 6, a respective strut 58 extends from the mid-point of each panel edge 50 to the mid-point of the adjoining panel edge 50 at the same level. In this variant, the components 58, although referred to above as braces, may act in tension or in compression depending upon how the dome structure is temporarily or permanently stressed. This applies, of course, also to the various structural elements in all of the variants described.

It will be appreciated that similar bracing arrangements to those illustrated in FIGS. 4, 5 and 6 could be arranged between adjacent frustums, so as to extend generally vertically, rattler than in a horizontal plane.

What is claimed is:

1. A domed building structure comprising a plurality of substantially concentric parts disposed one above the other and including a central upper apex part and a plurality of lower parts each forming a respective frustum adjoining the part immediately above and wherein each said frustum is formed of a plurality of straight edged panels each extending from an upper inner edge of the frustum to a lower outer edge and wherein each junction between panel edges and each said upper inner edge of each frustum is coincidental with a respective junction between panel edges and the adjoining edge of the frustum or central upper apex part immediately above, the structure comprising at least a first said frustum which consists of trapezoidal panels and triangular panels, at least a second said frustum adjoining and above said first frustum, said second frustum consisting of trapezoidal panels each having the shorter of its parallel edges lying in the upper inner edge of said second frustum and each having the longer of its parallel edges lying in the lower outer edge of said second frustum, the structure further comprising at least a third said frustum adjoining and below said first frustum, said third frustum consisting of trapezoidal panels each having the shorter of its parallel edges lying in the upper inner edge of said third frustum and the longer of its parallel edges lying in the lower outer edge of said third frustum, and wherein, in said first frustum, the triangular panels are arranged in groups of three adjoining panels, each said group comprising a middle panel having a vertex lying in the lower and outer edge of said first frustum and an opposite side lying in the upper and inner edge of said first frustum, the two other said triangular panels in each said group adjoining and lying on either side of the middle panel of the group and each said other panel in each said group having a vertex lying in the upper and inner edge of said first frustum and an opposite side lying in the lower and outer edge of said first frustum and wherein, in said first frustum, each said trapezoidal panel is disposed between two said groups of three triangular panels and has the shorter of its parallel edges lying in the lower, outer, edge of said first frustum and the longer of its parallel edges lying in the upper, inner edge of said first frustum.

2. A domed building structure comprising a plurality of substantially concentric parts disposed one above the other and including a central upper apex part and a plurality of lower parts each forming a respective frustum adjoining the part immediately above and wherein each said frustum is formed of a plurality of straight edged panels each extending from an upper inner edge of the frustum to a lower outer edge and wherein each junction between panel edges and each said upper inner edge of each frustum is coincidental with a respective junction between panel edges and the adjoining edge of the frustum or central upper apex part immediately above, the structure comprising at least a first said frustum which consists of trapezoidal panels and triangular panels, at least a second said frustum adjoining and above said first frustum, said second frustum consisting of trapezoidal panels each having the shorter of its parallel edges lying in the upper inner edge of said second frustum and each having the longer of its parallel edges lying in the lower outer edge of said second frustum, the structure further comprising at least a third said frustum below said first frustum, said third frustum consisting of trapezoidal panels each having the shorter of its parallel edges lying in the upper inner edge of said third frustum and the longer of its parallel edges lying in the lower outer edge of said third frustum, and wherein, in said first frustum, the triangular panels are arranged in groups of five adjoining panels, each said group comprising a middle panel having a vertex lying in the upper and inner edge of said first frustum and an opposite side lying in the lower and outer edge of said first frustum, each said group of five comprising, on each side of said middle panel, a respective intermediate triangular panel adjoining and lying on a respective side of the middle panel of the group, each said intermediate panel in each said group having a vertex lying in the lower and outer edge of said first frustum and an opposite side lying in the upper and inner edge of said first frustum, each said group of triangular panels further including two outer panels each adjoining and lying on the side of a respective said intermediate panel remote from the middle panel of the group and each said outer panel having a vertex lying in the upper and inner edge of said first frustum and a base lying in the lower and outer edge of said first frustum, and wherein, in said first frustum, each said trapezoidal panel is disposed between two said groups of five triangular panels and has the shorter of its parallel edges lying in the lower, outer, edge of said first frustum and the longer of its parallel edges lying in the upper, inner edge of said first frustum.

* * * * *

UNITED STATES PATENT AND TRADEMARK OFFICE

CERTIFICATE OF CORRECTION

PATENT NO. : 6,647,672 B1
DATED : November 18, 2003
INVENTOR(S) : Brian Valentine Knight It is certified that error appears in the above-identified patent and that said Letters Patent is hereby corrected as shown below:

Column 1,
Line 33, “paneling” should read -- panellising --.
Line 45, “frustum is” should read -- frustums --.

Column 2,
Line 34, “pall” should read -- part --.

Column 3,
Line 29, “all” should read -- an --.

Column 4,
Line 16, “tile” should read -- the --.
Line 41, “foam” should read -- form --.

Column 5,
Line 15, “oil” should read -- on --.

Signed and Sealed this

Ninth Day of March, 2004

JON W. DUDAS
*Acting Director of the United States Patent and Trademark Office*